US008500038B2

(12) United States Patent
Fuller et al.

(10) Patent No.: US 8,500,038 B2
(45) Date of Patent: Aug. 6, 2013

(54) GAS SPLATTERED FLUID DISPLAY

(75) Inventors: Mark W. Fuller, Toluca Lake, CA (US); Michael Jason Baldwin, Los Angeles, CA (US); Keith J. Kalis, Lancaster, CA (US); Helen S. Park, La Crescenta, CA (US); Riae Yoo, Glendale, CA (US)

(73) Assignee: WET Enterprises, Inc., Sun Valley, CA (US)

( * ) Notice: Subject to any disclaimer, the term of this patent is extended or adjusted under 35 U.S.C. 154(b) by 942 days.

(21) Appl. No.: 12/130,855

(22) Filed: May 30, 2008

(65) Prior Publication Data

US 2008/0296787 A1 Dec. 4, 2008

Related U.S. Application Data

(60) Provisional application No. 60/941,426, filed on Jun. 1, 2007.

(51) Int. Cl.
*F21S 8/00* (2006.01)

(52) U.S. Cl.
USPC ..... 239/18; 239/17; 239/22; 239/23; 239/77; 40/406; 40/407; 40/442; 472/57; 472/61; 472/65; 261/75; 261/118

(58) Field of Classification Search
USPC ..... 472/57, 61, 65; 40/406, 407, 442; 239/17, 239/18, 22, 23, 77; 261/75, 118
See application file for complete search history.

(56) References Cited

U.S. PATENT DOCUMENTS

| | | | | | |
|---|---|---|---|---|---|
| 1,533,738 | A | * | 4/1925 | Kane et al. | 239/20 |
| 1,775,885 | A | * | 9/1930 | Best | 40/406 |
| 1,802,082 | A | * | 4/1931 | Kloppe | 239/18 |
| 3,045,931 | A | * | 7/1962 | Hall | 239/598 |
| 3,226,029 | A | * | 12/1965 | Goodman et al. | 239/4 |
| 3,334,816 | A | * | 8/1967 | Mizuno | 239/18 |
| 3,537,650 | A | * | 11/1970 | Peczeli et al. | 239/405 |
| 3,711,698 | A | * | 1/1973 | Hess | 40/407 |
| 4,002,293 | A | * | 1/1977 | Simmons | 239/11 |
| 4,160,427 | A | * | 7/1979 | Holbrook | 119/254 |
| 4,395,835 | A | * | 8/1983 | Schneider | 40/406 |
| 4,715,136 | A | * | 12/1987 | Fuller et al. | 40/406 |
| 4,749,126 | A | * | 6/1988 | Kessener et al. | 239/12 |
| 4,901,922 | A | * | 2/1990 | Kessener et al. | 239/12 |
| 4,974,779 | A | * | 12/1990 | Araki et al. | 239/18 |
| 4,978,066 | A | * | 12/1990 | Fuller et al. | 239/12 |
| 5,067,653 | A | * | 11/1991 | Araki et al. | 239/18 |
| 5,115,973 | A | * | 5/1992 | Fuller et al. | 239/20 |
| 5,265,802 | A | * | 11/1993 | Hobbs et al. | 239/18 |
| 5,270,752 | A | * | 12/1993 | Kataoka et al. | 353/28 |

(Continued)

*Primary Examiner* — Christopher P Jones
(74) *Attorney, Agent, or Firm* — Blakely, Sokoloff, Taylor & Zafman LLP

(57) ABSTRACT

A fluid display includes a fluid source, a gas source, and a light source. The fluid source coherently emits fluid along a first trajectory. The gas source emits gas along a second trajectory that intersects the first trajectory. The light source is directed toward the intersection of the first trajectory and the second trajectory. The second trajectory may intersect the first trajectory at an oblique angle. The fluid source and/or the gas source may emit intermittently. The fluid source may emit a laminar jet or spherical fluid globules. The gas source may intermittently emit a gas vortex. The gas may be a flammable gas. The fluid may be water and the gas may be air. The fluid display may provide a "water sparkler" effect.

30 Claims, 2 Drawing Sheets

U.S. PATENT DOCUMENTS

| | | | | |
|---|---|---|---|---|
| 5,349,771 | A * | 9/1994 | Burnett | 40/406 |
| 5,416,994 | A * | 5/1995 | McLaughlin | 40/406 |
| 5,445,322 | A * | 8/1995 | Formhals et al. | 239/18 |
| 5,579,998 | A * | 12/1996 | Hall et al. | 239/9 |
| 5,961,042 | A * | 10/1999 | Doyle | 239/12 |
| 5,989,128 | A * | 11/1999 | Baker et al. | 472/65 |
| 6,056,213 | A * | 5/2000 | Ruta et al. | 239/337 |
| 6,402,045 | B1 * | 6/2002 | Persson | 239/1 |
| 6,644,561 | B1 * | 11/2003 | Daane | 239/18 |
| 6,681,508 | B2 * | 1/2004 | Unger et al. | 40/406 |
| 6,702,687 | B1 * | 3/2004 | Henry | 472/128 |
| 6,866,205 | B2 * | 3/2005 | Bennett et al. | 239/18 |
| 6,935,760 | B2 * | 8/2005 | Bar-Cohen | 362/96 |
| 2002/0176246 | A1 * | 11/2002 | Chen | 362/101 |
| 2006/0163374 | A1 * | 7/2006 | Wooten | 239/18 |
| 2006/0175423 | A1 * | 8/2006 | White et al. | 239/18 |
| 2007/0068053 | A1 * | 3/2007 | Troitski | 40/442 |

* cited by examiner

GAS SPLATTERED FLUID DISPLAY

CROSS REFERENCE TO RELATED APPLICATIONS

This application claims priority pursuant to 35 U.S.C. 119 (e) to U.S. Provisional Application No. 60/941,426, filed Jun. 1, 2007, which application is specifically incorporated herein, in its entirety, by reference.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1:
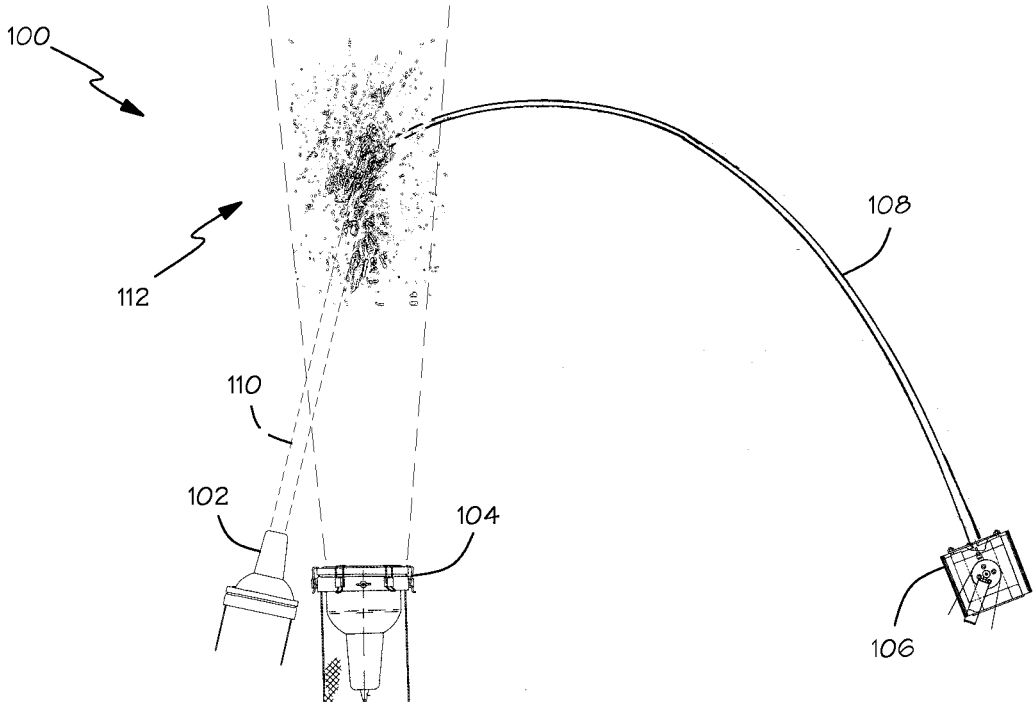
FIG. 1 is a side elevation of a schematic representation of a fluid display that embodies the invention.

As shown in FIG. 1, a fluid display 100 that embodies the invention includes a fluid source 106, a gas source 102, and a light source 104. The fluid source 106 coherently emits fluid along a first trajectory 108. Coherent fluid emission is used to mean that the fluid is emitted with very low turbulence, such as a laminar fluid jet. The laminar jet diameter may preferably be from ⅛ inch to 2 inches. A coherent fluid travels along a trajectory held together by the surface tension of the fluid and without breaking up into droplets. The fluid may be water. The gas source 102 emits gas along a second trajectory 110 that intersects the first trajectory 108. The gas may preferably be supplied at a pressure of approximately ¼ to 250 pounds per square inch. The gas may be air or an inert or a flammable gas.

The collision of the gas and fluid causes the coherent fluid to suddenly burst apart or splatter at the intersection 112 of the first trajectory 108 and the second trajectory 110. The light source 104 is directed toward the intersection 112. The fluid display 100 may provide a "water sparkler" effect in which the burst of water droplets refract and reflect the light to provide a decorative display.

As shown in FIG. 1, the second trajectory 110 may intersect the first trajectory 108 at an oblique angle. In other embodiments, the second trajectory may intersect the first trajectory at a right angle or an acute angle.

Figure 2:
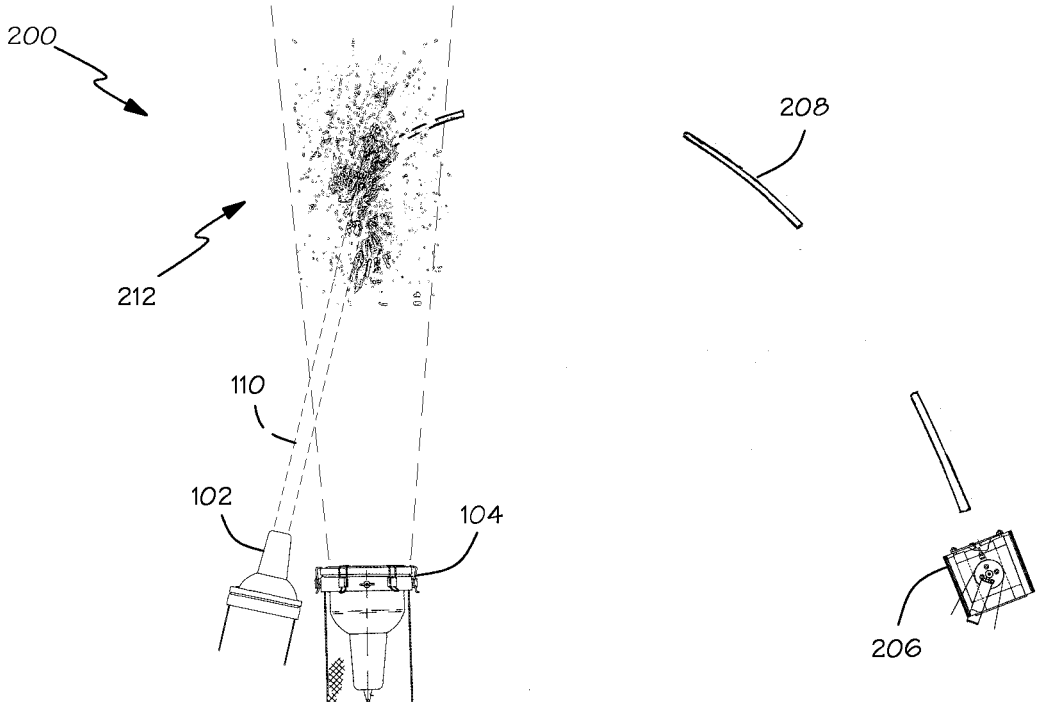
FIG. 2 is a side elevation of a schematic representation of another fluid display that embodies the invention.

FIG. 2 shows another fluid display 200 that embodies the invention. The fluid source 206 intermittently emits fluid along a first trajectory 208 producing a succession of coherent fluid slugs. Each slug bursts apart or splatters as it collides with the gas emitted by gas source 102 creating an intermittent burst at the intersection 212 of the first trajectory 208 and the second trajectory 110 illuminated by the light source 104.

Figure 3:
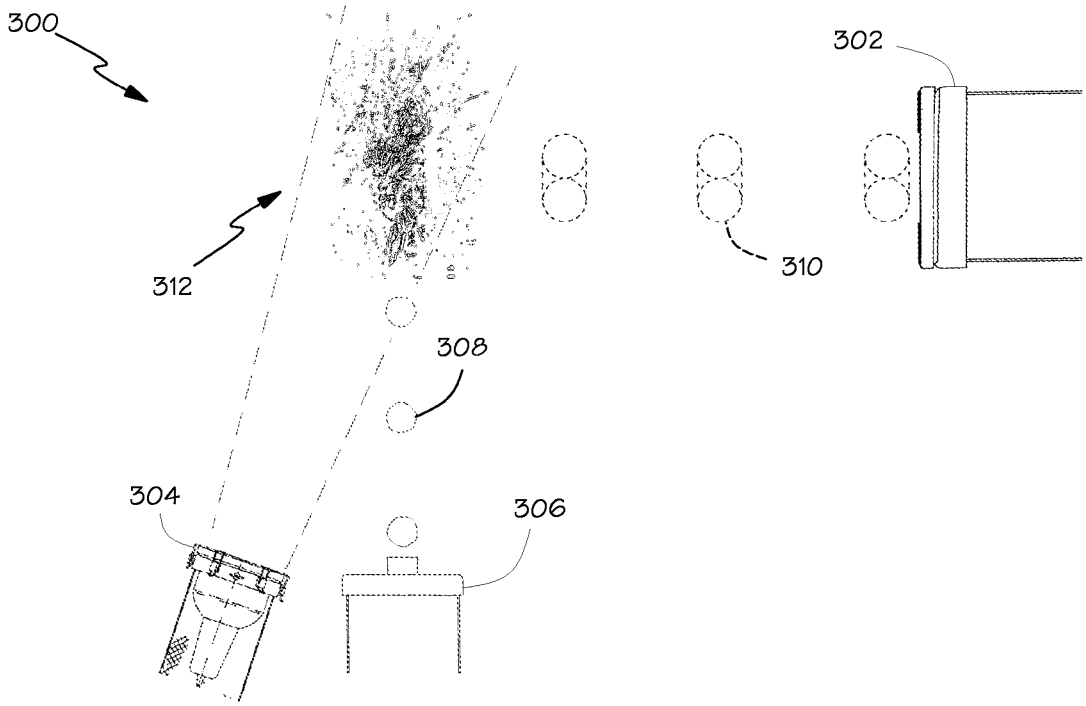
FIG. 3 is a side elevation of a schematic representation of another fluid display that embodies the invention.

FIG. 3 shows another fluid display 300 that embodies the invention. The fluid source 306 may emit a succession of fluid globules 308. The fluid source 306 emits the globules 308 with very low turbulence so that the fluid assumes a substantially spherical shape due to surface tension of the fluid. The globules travel along a first trajectory without breaking apart into droplets. The globules may preferably be from approximately ⅛ inch to 2 inches in diameter.

FIG. 3 shows a gas source 302 that intermittently emits a gas vortex 310 along a second trajectory that is perpendicular to the first trajectory. The emitted gas vortex 310 is a substantially toroidal pocket of gas rotating from the center of the toroid to the outer circumference and back to the center. The rotation of the gas in the vortex propels the vortex along the second trajectory allowing the vortex to be projected further than a simple gas jet. For example, a gas vortex may be projected 20 feet while maintaining substantial momentum.

The emission of the fluid globules 308 by the fluid source 306 is synchronized with emission of the gas vortices 310 by the gas source 302 so that the emitted fluid collides with the emitted gas at the intersection 312 of the first trajectory and the second trajectory. This creates intermittent bursts at the intersection 312 of the first trajectory and the second trajectory that are illuminated by the light source 304. It will be appreciated that the first trajectory may be at angles other than vertical and that the second trajectory may intersect the first trajectory at angles other than a right angle.

Figure 4:
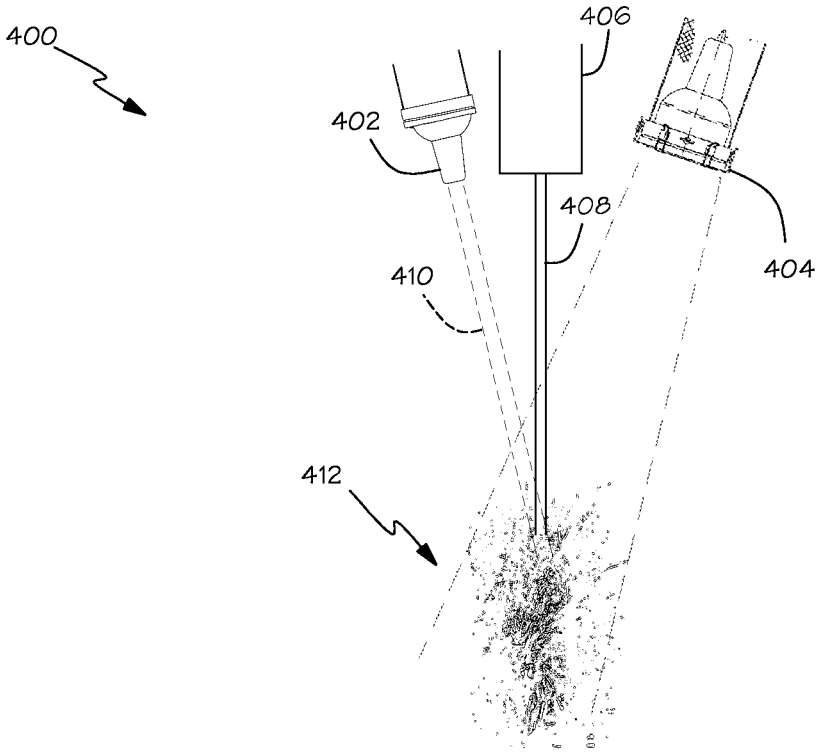
FIG. 4 is a side elevation of a schematic representation of another fluid display that embodies the invention.

FIG. 4 shows another fluid display 400 that embodies the invention. The fluid source 406 may emit a laminar fluid stream 408 that falls downward vertically. The gas source 402 emits gas along a second trajectory 410 that intersects the first trajectory 408 at an acute angle. The collision of the gas and fluid causes the coherent fluid to suddenly burst apart or splatter at the intersection 412 of the first trajectory 408 and the second trajectory 410. The light source 404 is directed toward the intersection 412 to provide a decorative display.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A fluid display comprising:

a liquid source device that intermittently and coherently emits a fluid globule of liquid along a first trajectory with very low turbulence so that the fluid globule assumes a substantially spherical shape due to surface tension;

a gas source device that emits gas along a second trajectory that intersects the first trajectory and causes the liquid to produce droplets at the intersection only when the fluid globule collides with the gas emitted by the gas source, the gas source device being separate and spaced apart from the liquid source device; and a light source that is directed toward the intersection of the first trajectory and the second trajectory such that the water droplets refract and reflect the light to provide a decorative display.

2. The fluid display of claim 1 wherein the liquid consists of water.

3. The fluid display of claim 1 wherein the second trajectory intersects the first trajectory at an oblique angle.

4. The fluid display of claim 1 wherein the liquid source emits a laminar fluid jet having a diameter from ⅛ inch to 2 inches.

5. The fluid display of claim 1 wherein the gas source emits gas intermittently.

6. The fluid display of claim 1 wherein the gas source intermittently emits a gas vortex consisting of a substantially toroidal pocket of gas rotating from a center of the toroid to an outer circumference and back to the center, rotation of the gas in the vortex propelling the vortex along the second trajectory.

7. The fluid display of claim 1 wherein the gas source emits gas intermittently and the liquid source is synchronized with the gas source so that the emitted liquid collides with the emitted gas at the intersection of the first trajectory and the second trajectory.

8. The fluid display of claim 1 wherein the gas is a flammable gas.

9. A fluid display comprising:

means for intermittently and coherently emitting a fluid globule of liquid along a first trajectory with very low turbulence so that the fluid globule assumes a substantially spherical shape due to surface tension;

means for emitting gas along a second trajectory that intersects the first trajectory and causing the liquid to produce water droplets at the intersection only when the fluid globule collides with the gas emitted by the gas source, the means for emitting gas being separate and spaced apart from the means for coherently emitting liquid; and means for illuminating the intersection of the first trajectory and the second trajectory such that the water droplets refract and reflect the light to provide a decorative display.

10. The fluid display of claim 9 wherein the means for emitting gas intermittently emits a gas vortex.

11. The fluid display of claim 9 wherein the means for emitting gas emits gas intermittently and the means for coherently emitting liquid is synchronized with the means for emitting gas so that the emitted liquid collides with the emitted gas at the intersection of the first trajectory and the second trajectory.

12. A method for producing a fluid display comprising:

intermittently and coherently emitting a fluid globule of liquid along a first trajectory with very low turbulence so that the fluid globule assumes a substantially spherical shape due to surface tension using a liquid source device;

emitting gas along a second trajectory that intersects the first trajectory with a gas source device separate and spaced apart from the liquid source device, and causing the liquid to produce droplets at the intersection only when the fluid globule collides with the gas emitted by the gas source; and illuminating the intersection of the first trajectory and the second trajectory such that the water droplets refract and reflect the light to provide a decorative display.

13. The method of claim 12 wherein emitting gas further comprises intermittently emitting a gas vortex consisting of a substantially toroidal pocket of gas rotating from a center of the toroid to an outer circumference and back to the center, rotation of the gas in the vortex propelling the vortex along the second trajectory.

14. The method of claim 12 wherein emitting gas further comprises intermittently emitting gas and the method further comprises synchronizing intermittently emitting liquid with intermittently emitting gas so that the emitted liquid collides with the emitted gas at the intersection of the first trajectory and the second trajectory.

15. A fluid display comprising:

a liquid source device that intermittently and coherently emits a laminar fluid jet of liquid to produce coherent fluid slugs along a first trajectory;

a gas source device that emits gas along a second trajectory that intersects the first trajectory and causes the liquid to produce droplets at the intersection only when the coherent fluid slugs collide with the gas emitted by the gas source, the gas source device being separate and spaced apart from the liquid source device; and a light source that is directed toward the intersection of the first trajectory and the second trajectory such that the water droplets refract and reflect the light to provide a decorative display.

16. The fluid display of claim 15 wherein the liquid consists of water.

17. The fluid display of claim 15 wherein the second trajectory intersects the first trajectory at an oblique angle.

18. The fluid display of claim 15 wherein the liquid source emits a laminar fluid jet having a diameter from ⅛ inch to 2 inches.

19. The fluid display of claim 15 wherein the gas source emits gas intermittently.

20. The fluid display of claim 15 wherein the gas source intermittently emits a gas vortex consisting of a substantially toroidal pocket of gas rotating from a center of the toroid to an outer circumference and back to the center, rotation of the gas in the vortex propelling the vortex along the second trajectory.

21. The fluid display of claim 15 wherein the gas source emits gas intermittently and the liquid source is synchronized with the gas source so that the emitted liquid collides with the emitted gas at the intersection of the first trajectory and the second trajectory.

22. The fluid display of claim 15 wherein the gas is a flammable gas.

23. A fluid display comprising:

a liquid source device that coherently emits liquid along a first trajectory;

a gas source device that intermittently emits a gas vortex consisting of a substantially toroidal pocket of gas rotating from a center of the toroid to an outer circumference and back to the center, rotation of the gas in the vortex propelling the vortex along a second trajectory that intersects the first trajectory and causes the liquid to produce droplets at the intersection, the gas source device being separate and spaced apart from the liquid source device; and a light source that is directed toward the intersection of the first trajectory and the second trajectory such that the water droplets refract and reflect the light to provide a decorative display.

24. The fluid display of claim 23 wherein the liquid consists of water.

25. The fluid display of claim 23 wherein the second trajectory intersects the first trajectory at an oblique angle.

26. The fluid display of claim 23 wherein the liquid source emits a laminar fluid jet having a diameter from ⅛ inch to 2 inches.

27. The fluid display of claim 23 wherein the liquid source intermittently emits a laminar fluid jet to produce coherent fluid slugs that produce droplets only when the coherent fluid slugs collide with the gas emitted by the gas source.

28. The fluid display of claim 23 wherein the liquid source intermittently emits a fluid globule with very low turbulence so that the fluid globule assumes a substantially spherical shape due to surface tension and produces droplets only when the fluid globule collides with the gas emitted by the gas source.

29. The fluid display of claim 23 wherein the liquid source emits liquid intermittently and the liquid source is synchronized with the gas source so that the emitted liquid collides with the emitted gas at the intersection of the first trajectory and the second trajectory.

30. The fluid display of claim 23 wherein the gas is a flammable gas.

* * * * *